US011365942B2

(12) United States Patent
Kelley et al.

(10) Patent No.: US 11,365,942 B2
(45) Date of Patent: Jun. 21, 2022

(54) INTEGRAL HEAT EXCHANGER MOUNTS

(71) Applicant: Hamilton Sundstrand Corporation, Charlotte, NC (US)

(72) Inventors: Ryan Matthew Kelley, Bloomfield, CT (US); Gabriel Ruiz, Granby, CT (US); James Streeter, Torrington, CT (US); Michael Zager, Windsor, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 15/923,622

(22) Filed: Mar. 16, 2018

(65) Prior Publication Data

US 2019/0285369 A1 Sep. 19, 2019

(51) Int. Cl.

| | |
|---|---|
| ***F28F 9/26*** | (2006.01) |
| ***F28D 7/16*** | (2006.01) |
| ***F28F 9/02*** | (2006.01) |
| ***F28F 9/00*** | (2006.01) |
| ***F28F 9/007*** | (2006.01) |

(52) U.S. Cl.

CPC ..... *F28F 9/26* (2013.01); *F28D 7/1615* (2013.01); *F28F 9/002* (2013.01); *F28F 9/007* (2013.01); *F28F 9/0246* (2013.01); *F28F 2255/14* (2013.01); *F28F 2255/18* (2013.01); *F28F 2280/00* (2013.01)

(58) Field of Classification Search

CPC .... F28F 9/013; F28F 9/26; F28F 9/268; F28F 9/0246; F28D 7/16; F28D 7/1615; B33Y 80/00

See application file for complete search history.

(56) References Cited

U.S. PATENT DOCUMENTS 1,868,639 A * 7/1932 Metzgar ..... F28F 9/22 165/68
1,891,607 A * 12/1932 Rainey ..... F28B 9/08 165/67
1,918,601 A * 7/1933 Jacocks ..... F28D 7/0058 165/67
2,064,931 A 12/1936 Lysholm (Continued)

FOREIGN PATENT DOCUMENTS

DE 102015204014 A1 9/2016
EP 3225948 A1 10/2017

(Continued)

OTHER PUBLICATIONS

Extended European Search Report for EP Application No. 19157280.9, dated Jul. 26, 2019, 8 pages.

(Continued)

*Primary Examiner* — Tho V Duong
(74) *Attorney, Agent, or Firm* — Kinney & Lange, P.A.

(57) ABSTRACT

An embodiment of a heat exchanger assembly includes a first manifold adapted for receiving a first medium, a core adapted for receiving and placing a plurality of mediums, including the first medium, in at least one heat exchange relationship, and a core meeting the first manifold at a first core/manifold interface; The mounting structure supports a heat exchanger, and is metallurgically joined to at least one heat exchanger assembly component at a first joint integrally formed with the mounting structure.

5 Claims, 8 Drawing Sheets

(56) References Cited

U.S. PATENT DOCUMENTS

| | | | | |
|---|---|---|---|---|
| 3,486,489 | A | 12/1969 | Huggins | |
| 3,559,722 | A * | 2/1971 | Schauls | F28D 9/0068 165/166 |
| 3,601,185 | A | 8/1971 | Rothman | |
| 3,967,354 | A | 7/1976 | Jaspers | |
| 4,049,051 | A | 9/1977 | Parker | |
| 4,308,915 | A | 1/1982 | Sanders et al. | |
| 4,570,700 | A | 2/1986 | Ohara et al. | |
| 4,645,000 | A | 2/1987 | Scarselletta | |
| 5,383,516 | A | 1/1995 | Dinulescu | |
| 6,237,678 | B1 | 5/2001 | Yamada | |
| 6,321,835 | B1 * | 11/2001 | Damsohn | F28D 7/0041 165/109.1 |
| 6,520,252 | B1 | 2/2003 | Bizzarro | |
| 7,159,649 | B2 | 1/2007 | Thyrum et al. | |
| 8,726,976 | B2 | 5/2014 | Schrader et al. | |
| 9,835,380 | B2 | 12/2017 | Kupiszewski et al. | |
| 2002/0023741 | A1 | 2/2002 | Brenner et al. | |
| 2002/0066554 | A1 | 6/2002 | Oh et al. | |
| 2003/0196785 | A1 * | 10/2003 | Knecht | F28D 7/1684 165/148 |
| 2006/0283585 | A1 | 12/2006 | Smith et al. | |
| 2010/0139901 | A1 * | 6/2010 | Takada | F28F 3/025 165/166 |
| 2012/0000634 | A1 | 1/2012 | Rod et al. | |
| 2015/0000865 | A1 * | 1/2015 | Ueda | F02C 7/14 165/51 |
| 2017/0023311 | A1 | 1/2017 | Urbanski | |
| 2017/0023312 | A1 | 1/2017 | Urbanski | |
| 2017/0030651 | A1 | 2/2017 | Rock, Jr. et al. | |
| 2017/0045312 | A1 | 2/2017 | Contet et al. | |
| 2017/0089643 | A1 | 3/2017 | Arafat | |
| 2017/0146303 | A1 * | 5/2017 | Mayo | F28F 9/0075 |
| 2017/0205157 | A1 | 7/2017 | Stieber | |
| 2017/0211892 | A1 | 7/2017 | Lim et al. | |
| 2017/0336155 | A1 | 11/2017 | Fennessy | |
| 2017/0356696 | A1 | 12/2017 | Zaffetti et al. | |
| 2018/0043482 | A1 | 2/2018 | Vos et al. | |
| 2018/0058765 | A1 | 3/2018 | Parfenov | |
| 2018/0345353 | A1 * | 12/2018 | Martin | B22F 5/106 |
| 2019/0024988 | A1 * | 1/2019 | Wilson | F28F 9/0214 |
| 2019/0120562 | A1 * | 4/2019 | Fuller | F28F 9/0275 |

FOREIGN PATENT DOCUMENTS

| | | | | |
|---|---|---|---|---|
| FR | 2124043 | A1 * | 9/1972 | B21D 53/02 |
| GB | 1261018 | A * | 1/1972 | F22G 1/005 |
| GB | 2537503 | A | 10/2016 | |
| WO | WO2006/102736 | A1 | 10/2006 | |
| WO | WO2016/069354 | A1 | 5/2016 | |

OTHER PUBLICATIONS

Extended European Search Report for EP Application No. 19163297.5, dated Sep. 6, 2019, 9 pages.

Communication Pursuant to Article 94(3) EPC for Application No. 19163297.5, dated Apr. 23, 2021 4 pages.

* cited by examiner

INTEGRAL HEAT EXCHANGER MOUNTS

BACKGROUND

The disclosure is directed generally to heat exchangers, and more specifically to cores and mounts for heat exchangers.

Mounts are used to connect the heat exchanger to other components or the aircraft directly. There are loads applied from the connecting body to the heat exchanger creating a stress at the connection between the mount and the core. Typically, the mount is brazed and/or welded to the core and the load is transmitted through the joint and internal core components, at roughly a 45° angle outward from the joint in this example.

SUMMARY

An embodiment of a heat exchanger assembly includes a first manifold adapted for receiving a first medium, a core adapted for receiving and placing a plurality of mediums, including the first medium, in at least one heat exchange relationship, and a core meeting the first manifold at a first core/manifold interface; The mounting structure supports a heat exchanger, and is metallurgically joined to at least one heat exchanger assembly component at a first joint integrally formed with the mounting structure.

An embodiment of a method of making a heat exchanger assembly includes forming a mounting structure for a heat exchanger assembly, and integrally forming the mounting structure with at least one component of the heat exchanger assembly via a first joint formed from one or more of a casting process or an additive manufacturing process.

DETAILED DESCRIPTION

Integrally building a mount with the core using additive manufacturing or castings, removes the need to braze, machine, and/or weld the mount to a pad. This can increase the effective contact area between the mount and the core, allowing the load to be distributed better through the core components. Additionally, the structure can be optimized for weight without having to maintain unnecessary material needed to connect the mount to the heat exchanger. Assembly weight, installation time, installation space, and component count may all be reduced.

Figure 1:
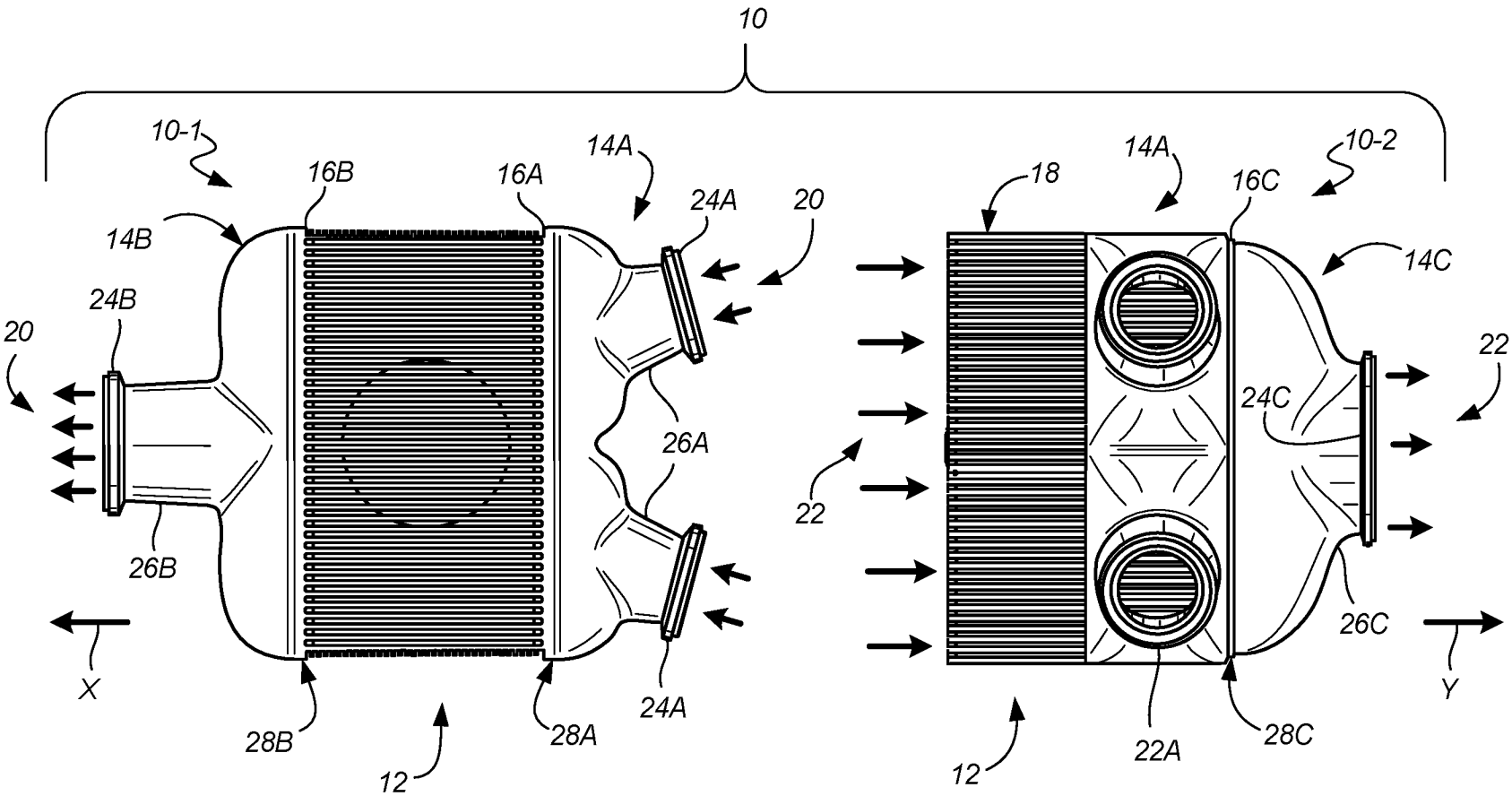
FIG. 1 includes multiple views of an example heat exchanger.

FIG. 1 shows an example heat exchanger assembly 10, with first and second views 10-1 and 10-2. At its most basic, assembly 10 is constructed from assembly components including at least core 12 and one or more manifolds 14A, 14B, 14C meeting at respective manifold/core interfaces 16A, 16B, 16C. First manifold 14A and second manifold 14B are connected to and in fluid communication with core 12 at respective first and second manifold/core interfaces 16A, 16B. Core 12 generally receives and places a plurality of mediums (here 20, 22) in at least one heat exchange relationship with one another. As is generally known in the art, core 12 can include structures, walls, tubes, etc. to facilitate a cross-flow, counter-flow, micro-channel, or other hybrid heat exchange relationship. In this particular non-limiting example, heat exchanger assembly 10 can include a plate-and-fin heat exchanger or any other type of heat exchanger that, generally, consists of alternating layers (e.g., micro-channel heat exchangers). Assembly 10 can also include one or more mount areas (not shown in FIG. 1) for supporting heat exchanger assembly 10 in a larger system.

One or more manifolds (here, first manifold 14A) include a first end 26A distal from core 12 with at least one port 24A adapted to receive (or discharge) a first medium of the plurality of mediums (e.g., medium 20 or 22). Second end 28A of first manifold 14A is joined to core 12 at first manifold/core interface 16A, and is adapted to transfer first medium 20 or second medium 22, either to or from a plurality of first heat exchange passages in core 12. Similarly, second manifold 14B includes a first end 26B and a second end 28B, the first end distal from core 12 with at least one port 24B adapted to discharge (or receive) the first medium 20. Second end 28B of second manifold 14B is joined to core 12 at second manifold/core interface 16B, and is adapted to transfer first medium 20 either to or from a plurality of first heat exchange passages in core 12.

Third manifold 14C includes first end 26C and second end 28C for medium 22 to exit core 12 via port 24C. Thus, via manifolds 14A, 14B, 14C, core 12 receives first medium 20 flowing in first direction X and second medium 22 of the plurality of mediums flowing in second direction Y at a zero or nonzero angle relative to first direction X. These directions may vary from layer to layer within the core, for example in a counterflow heat exchanger core, versus the cross-flow arrangement shown in FIG. 1.

Figure 2A:
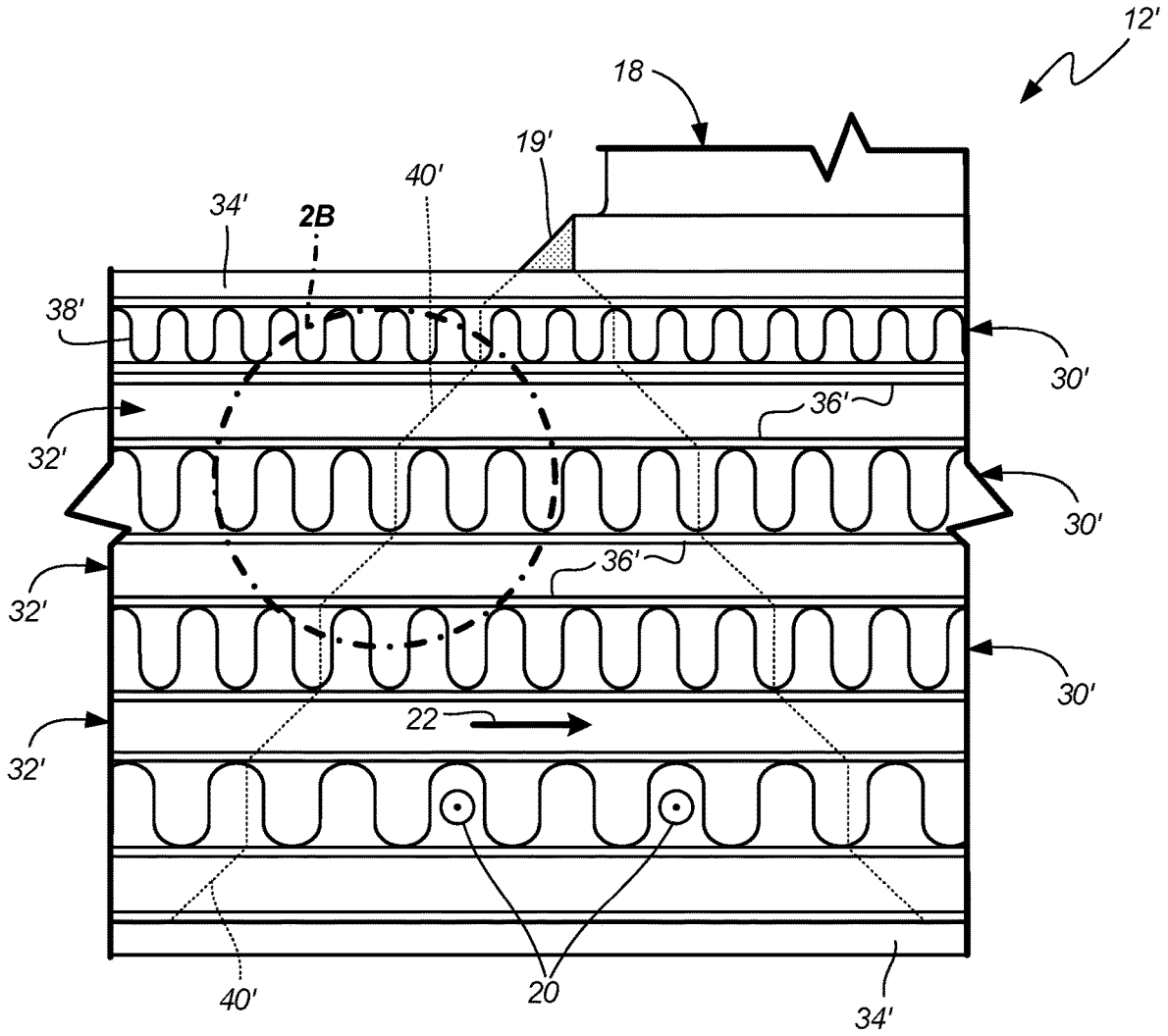
(Prior Art) FIG. 2A
FIG. 2A shows a conventional core geometry of a plate-and-fin heat exchanger.
Figure 2B:
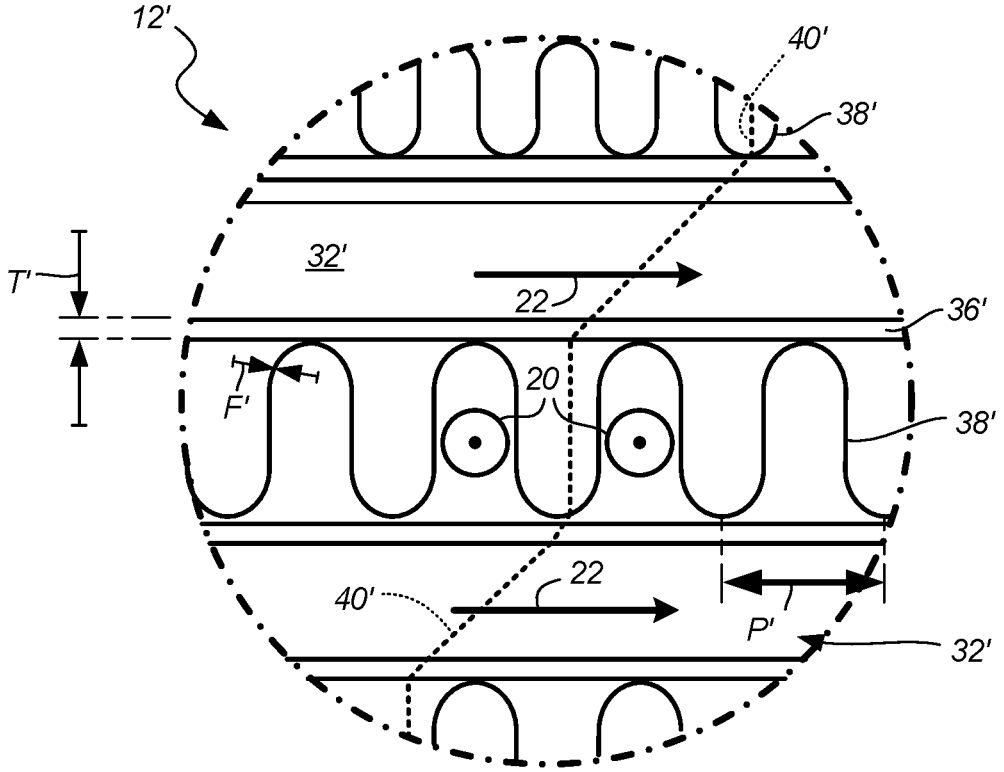
(Prior Art) FIG. 2B
FIG. 2B is a magnified view of a portion of FIG. 2A.

FIGS. 2A and 2B show a conventional geometry for a plate-and-fin heat exchanger core 12'. Specifically, core 12' includes walls defining a topology of alternating flow layers 30', 32' respectively for first medium 20 and second medium 22. Between upper and lower end plates 34', parting plates 36' separate and define alternating flow layers 30', 32'. In this example, first fins 38' provide additional heat transfer area for first medium 20 in first flow layers 30'. Optionally, second fins (omitted for clarity) can be provided in second flow layers 32' for providing additional heat transfer area for second medium 22.

In a mount arrangement for a conventional heat exchanger core, such as is shown in FIGS. 2A and 2B, certain parts of core 12', particularly load-bearing portion or portions of layers immediately adjacent to the mount location or joint bear a disproportionate amount of the weight, vibrational, and other loads as compared to other parts more distal from the load-bearing portion. This has traditionally been dealt with, due to manufacturability and cost concerns, by uniformly using thicker plate or fin material throughout individual layers in order to absorb and transmit the loads as shown, while preventing damage to the unit.

As can be seen in FIGS. 2A and 2B, each layer 30' of conventional core 12' has generally uniform topology though adjacent layers 30' likely differ. Each individual parting plate 36' has a uniform plate thickness T' across an individual heat transfer layer 30', while each fin 38' has substantially uniform fin thickness F' and pitch P' (e.g., spacing between corrugations) across an individual heat transfer layer 30'. Thus conventionally, plates 36' closer to the mount location(s) 18' and/or joint(s) 19' may have a greater thickness than those below. Similarly, conventional fins 38' in layers close to mount location(s) 18' and/or joint(s) 19' may have a greater fin thickness F' and/or lesser pitch P' (corrugations closer together) than those fins 38' in layers below (i.e., distal from) mount location(s) 18'. But again, thickness and pitch are conventionally uniform across each individual layer.

Conventional layer strengthening thus includes areas of the core outside of the parts nearest to the mount area and thus most responsible for load bearing. These regions are identified outside of dashed line 40' representing approximately a perimeter of the expected or actual load path. In conventional welded mounts 18' and joints 19', the load path extends approximately 45° outward through core 12', but the angle and exact path may vary depending on the types and numbers of attachment points. Regardless of the particular load path 40', arrangements like those in FIGS. 2A and 2B unnecessarily add weight, reduce available volume for throughput of the mediums, and can impede conduction of thermal energy through the heat transfer surfaces because non-load-bearing areas of the core are unnecessarily oversized.

Figure 3A:
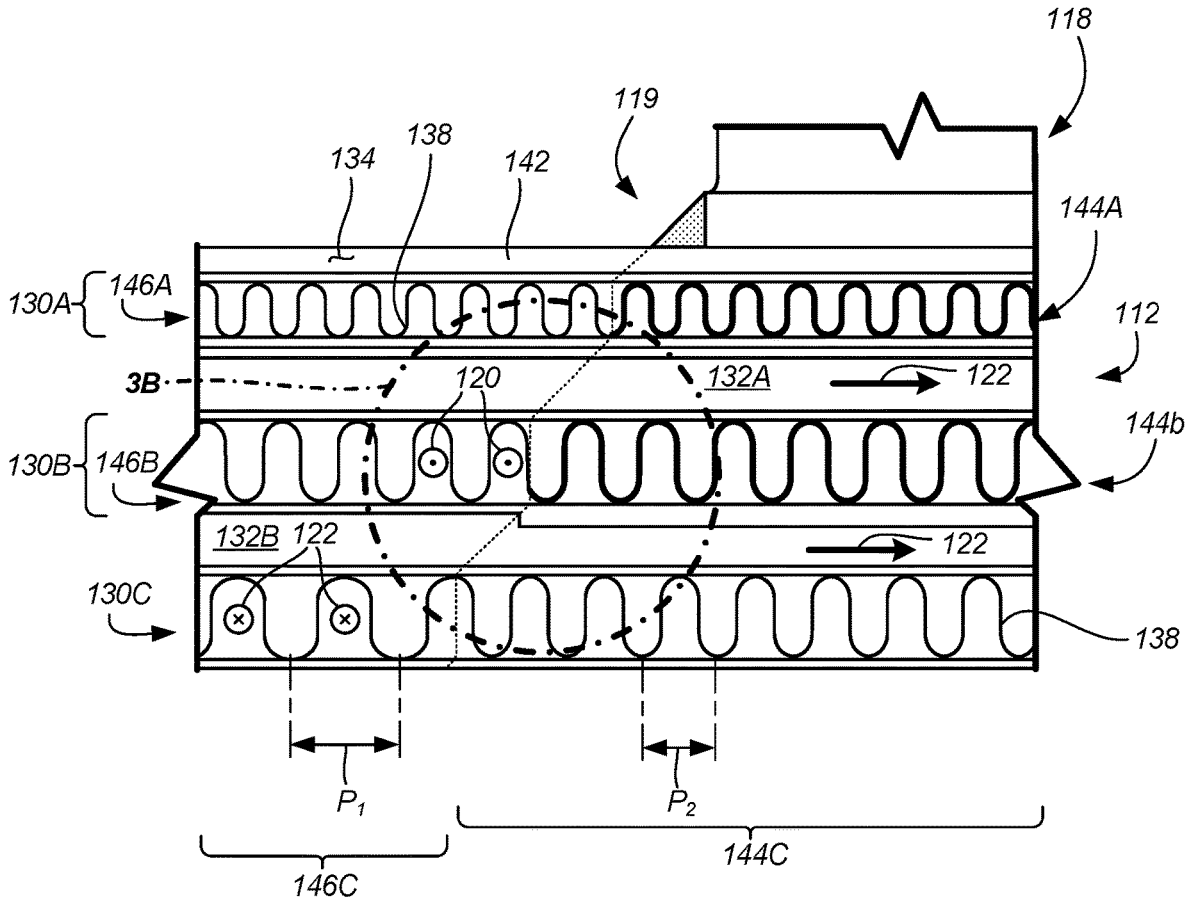
FIG. 3A shows an updated example core geometry for a plate-and-fin heat exchanger according to the disclosure.
Figure 3B:
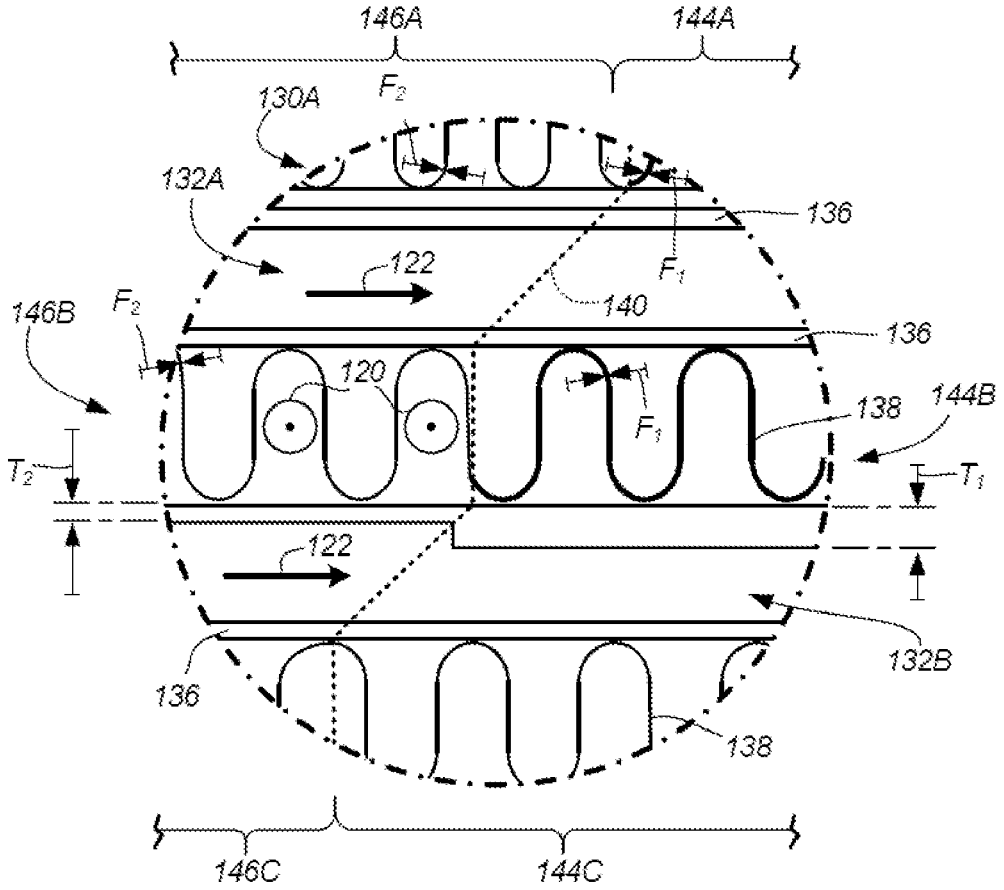
FIG. 3B is a magnified view of a portion of FIG. 3A.

FIGS. 3A and 3B show an updated example core 112 which, like conventional core 12' in FIGS. 2A and 2B, includes a plurality of walls defining a plurality of alternating layers for placing first and second mediums 120, 122 in at least one heat exchange relationship. FIGS. 3A and 3B show first layers 130A, 130B, 130C and second layers 132A, 132B of core 112. Each of first layers 130A, 130B, 130C has at least one corresponding load-bearing portion 144A, 144B, 144C aligned with, and adjacent to, at least a first mount location 118 and/or joint 119 on a perimeter 142 of core 112. Perimeter can be defined by, for example, closure bars or end plates 134. One or more non-load-bearing portions 146A, 146B, 146C of each layer 130A, 130B, 130C can be located distal from load-bearing portion(s) 144A, 144B, 144C. Load-bearing portions of second layers 132A, 132B can also be strengthened in a similar manner, but these are omitted for clarity.

To optimize aspects of the core design with minimal weight addition and flow disruption, a topology of the first load-bearing portion 144A has an overall load bearing capacity greater than a load bearing capacity of the non-load-bearing portion 146A in the same layer 130A. That is, at least one layer 130A of core 112 is locally strengthened by varying one or more aspects of the walls (e.g., plates, fins, tubes, etc.) defining the passages in the load-bearing portion. To save weight and material costs, parts of the layer remain sufficiently thin and/or well-spaced to manage desired medium flows. For illustrative purposes, first layers 130A, 130B, 130C shows one or more variation or adaptation in the respective load bearing portion 144A, 144B, 144C; however, it will be recognized that multiple aspects can be modified in each load-bearing portion(s) of one or more layers. In layer 130C, for example, a pitch $P_2$ of the plurality of corrugated fins 138 in load-bearing portion 144C is less than a pitch $P_1$ of the plurality of corrugated fins 138 in the same layer (130C) in the non-load-bearing portion 146C. That is, the sheet(s) forming the fins in layer 130C are further compressed in load-bearing portion 144C so that each wall or fin is closer to an adjacent one as compared to the spacing in non-load-bearing portion 146C. This can reduce available flow area locally, but by maintaining or even expanding pitch in non-load-bearing portion 146C, overall heat transfer and/or pressure drop can be substantially maintained relative to conventional designs.

In first layers 130A, 130B, for medium 120, a fin thickness $F_1$ of the plurality of fins 138 in load-bearing portions 144A, 144B is greater than a fin thickness $F_2$ of the plurality of corrugated fins 138 in the same layer (here 130A, 130B) in the respective non-load-bearing portions 146A, 146B. The locally thicker material in the load-bearing portion again can absorb and transmit forces, while allowing for thinner fin material elsewhere. This again may reduce local flow to a lesser degree as compared to a conventional approach.

In addition to the fins, dimensions or other aspects of parting plates can also be varied in the load-bearing portion(s) to improve strength versus the corresponding non-load-bearing portion. Here, in FIGS. 3A and 3B a thickness $T_1$ of one or more parting plates 136 separating the plurality of corrugated fins in the first load-bearing portion 144B is less than a thickness $T_2$ of the plurality of parting plates in the same layer in non-load-bearing portion 146B.

It will be recognized that load path 140, is merely illustrated for simplicity as a dashed line, but should not be read as a precise stepwise difference between the load-bearing and non-load-bearing portions in all cases. Rather, depending on the precise construction of the unit, the mount, and the loads applied thereto, there is somewhat of a gradual transition region on either side of dashed line 140 (and other load paths described herein). The dashed line(s) are therefore merely intended to represent an approximate midpoint of this transition region in order to more clearly and simply delineate the load-bearing and non-load-bearing portions without adding clutter to the figures.

Figure 4:
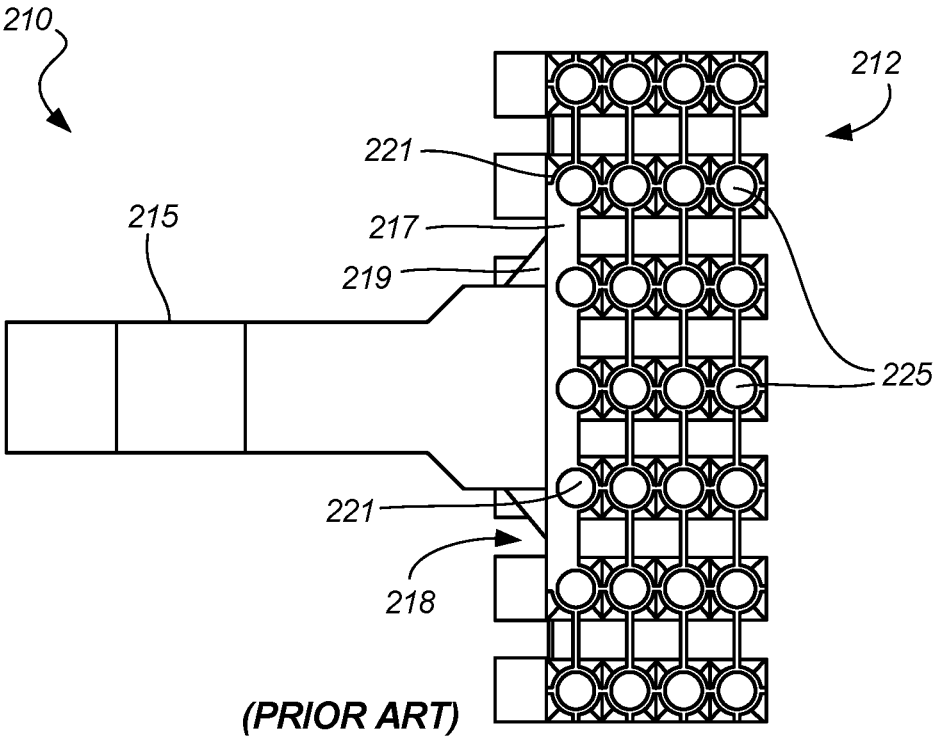
(PRIOR ART) FIG. 4
FIG. 4 is a conventional mounting arrangement for a shell-and-tube core of a heat exchanger.
Figure 5:
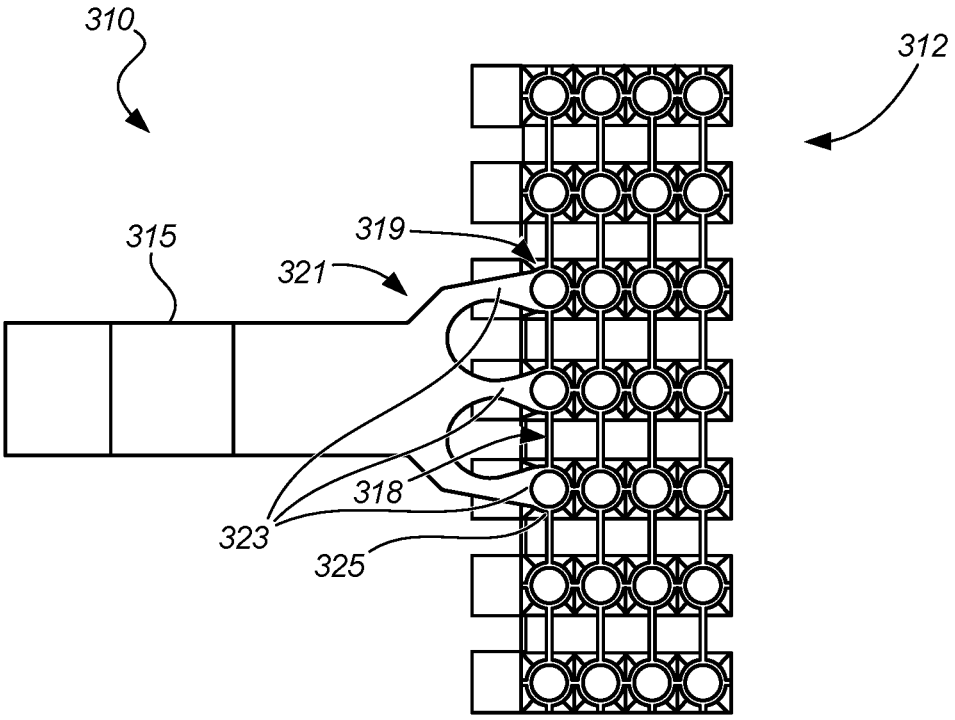
FIG. 5 shows an example mounting arrangement for a core of a shell-and-tube heat exchanger according to the disclosure.

Additionally or alternatively, a mounting structure or mount portion of the core is integrally formed with at least one of a mount pad and an end plate of the heat exchanger core. FIG. 4 shows a heat exchanger and accompanying mount structure, while FIG. 5 shows the mount includes at least one mount structure, such as an arm integrally supporting at least one element, a tube in this case, of the heat exchanger core. Additional embodiments show the heat exchanger assembly supportable by several mount structures integrally formed with one or more manifolds.

Beginning with FIG. 4, a conventional mounted heat exchanger assembly 210 includes core 212, mount bar 215, mount pad 217, mount location 218 on core 212, and joint(s) 219. Conventionally, mount pad 217 is attached to core 212 at mount location 218, in particular to multiple tubes 225 in a shell-and-tube arrangement shown herein. Mount pad 217 can be conventionally formed, for example, by machining, extrusion, and/or casting. Subsequently, mount bar 215 is welded, brazed, or otherwise metallurgically joined around joint 219 near a perimeter of mount pad 217, securing core 212 to one or more support structures (via mount bar 215). In this arrangement, loads from the aircraft or other mounting support structures (not shown) create high stress loads at connections 221 between mount pad 217 and tubes 225 in core 212.

In contrast, FIG. 5 includes assembly 310 with core 312 directly metallurgically joined to the mount by at least one joint 319, with core 312 adapted for receiving and placing a plurality of mediums in at least one heat exchange relationship. Joint 319 includes at least one passage wall (e.g., walls of at least one tube 325) integrally formed with mount bar 315 at mount location 318. As in FIG. 4, the heat exchanger comprises a shell-and-tube heat exchanger or a micro-channel heat exchanger.

Mount 321 includes at least one clevis leg or bar 323 integrally formed with and supported by at least one tube 325 of heat exchanger core 312. This allows for a substantially uniform connection between mount bar 315 and core 312, rather than merely about edges of mount pad 217 in FIG. 4.

Figure 6:
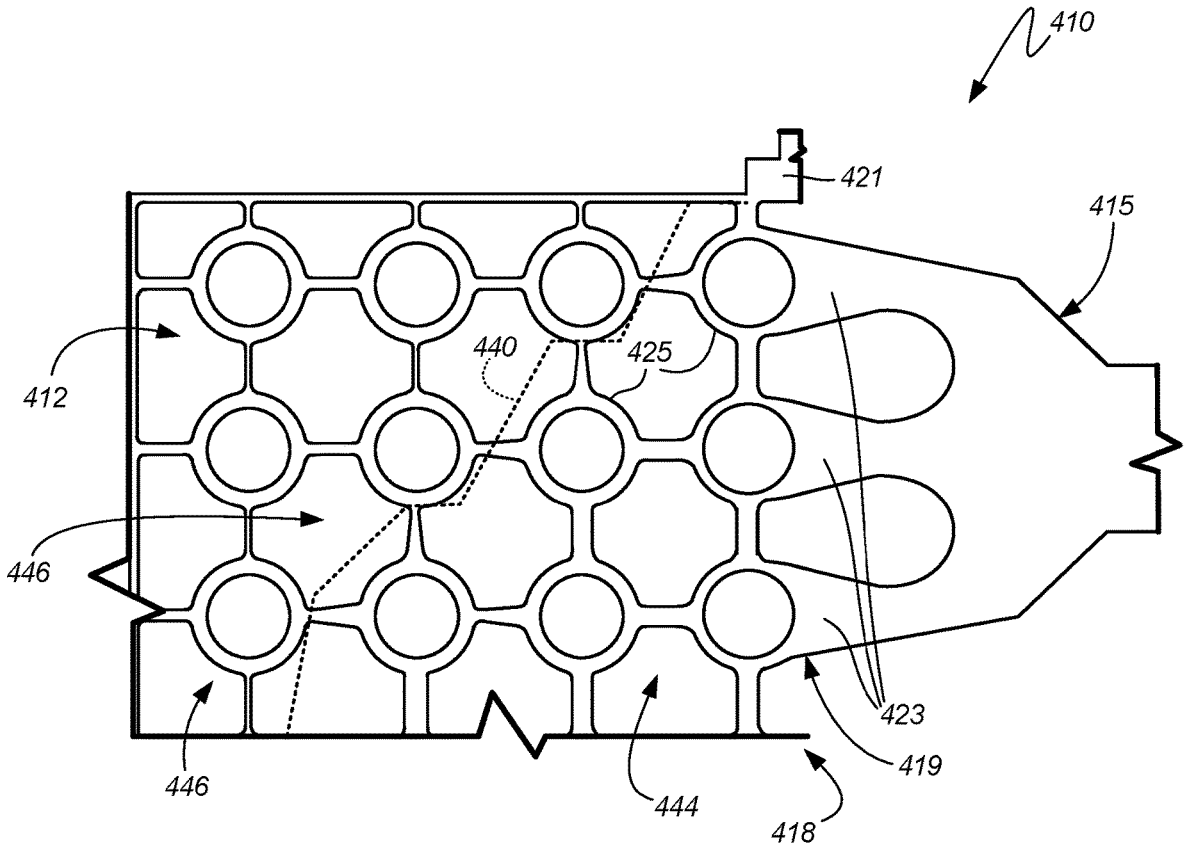
FIG. 6 shows a strengthened core topology and mounting arrangement for a heat exchanger embodiment.

FIG. 6 shows an alternate embodiment of heat exchanger assembly 410 for an example shell-and-tube heat exchanger core 412. Core 412, adapted for receiving and placing a plurality of mediums in at least one heat exchange relationship, includes one or more tubes 425 directly metallurgically joined around mount location 421 by at least one joint such as clevis leg or bar 423. Joint 419 includes at least one passage wall (e.g., walls of at least one tube 425) integrally formed with mount bar 415 at mount location (s) 418.

Mount 421 includes at least one branch 423 integrally supporting at least one tube 425 of shell-and-tube heat exchanger core 412. Mount 421 is also integrally formed with at least one of a mount pad and an end plate (not shown) of heat exchanger core 412. This allows for a substantially uniform connection between mount bar 415 and core 412, rather than merely about edges of mount pad (e.g., 217 in FIG. 4).

Core 412 also includes first load-bearing region 444 in connection with the joint/mount and a first non-load bearing region 446 outward of the non-load bearing region. As in FIGS. 3A and 3B, the heat exchanger core includes a different (stronger) topology in at least one load-bearing region (444) versus than in a corresponding at least one non-load-bearing region 446 in the same layer.

In this example, first load-bearing region 444 can be aligned with the at least one integrally formed joint 419 such that load path 440 includes both first load-bearing region 444 and the at least one integrally formed joint 419. Here, that includes thicker walled tubes 425 in load-bearing region 444 as compared to those outside (in the non-load-bearing region 446).

Embodiments of heat exchangers described herein can leverage additive manufacturing or any other manufacturing method or methods (e.g., casting) that allows one to construct continuous, homogeneous transitions between one or more mounts and the core, the manifold, or other assembly components. Continuous, homogeneous transitions between elements within the core can closely tailor load bearing capacity. Additive manufacturing is also useful in reducing mass and/or weight of different elements of the assembly, as well as reducing the number of details and associated assembly time. Further, additive manufacturing allows the mount to be optimized with less constraint on how to connect the mount to the heat exchanger core. The entire connection between the mount and heat exchanger is made by metallurgical bond instead of just welded edges as in the conventional approaches. The need for brazing the mount to achieve a uniform load distribution is eliminated, as is a more complicated brazing fixture that is typically required for brazed mounts. Quality of the resulting assembly is improved because full (or even 80%) braze joint coverage and/or full penetration welds are not consistently achievable, resulting in rejection of some parts when manufactured by brazing and/or welding. With additive manufacturing, material strength is not degraded as a result of welding and brazing, and the result is well-controlled joint topology.

Figure 7A:
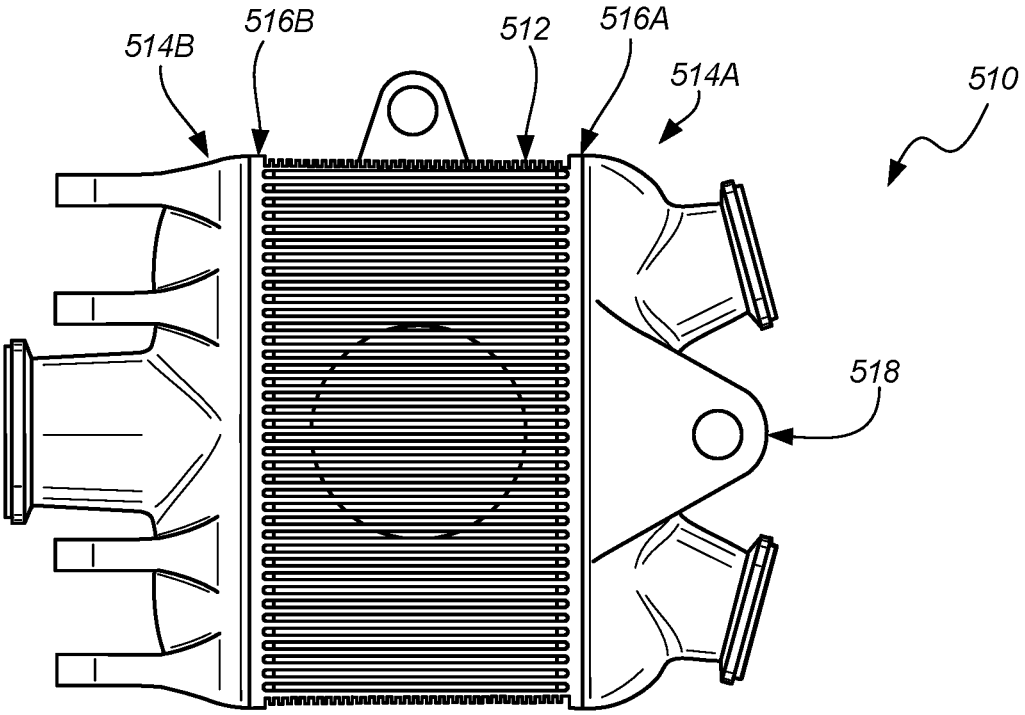
FIGS. 7A and 7B depict a third heat exchanger embodiment with mounts integrally formed with one or more manifolds.
Figure 7B:
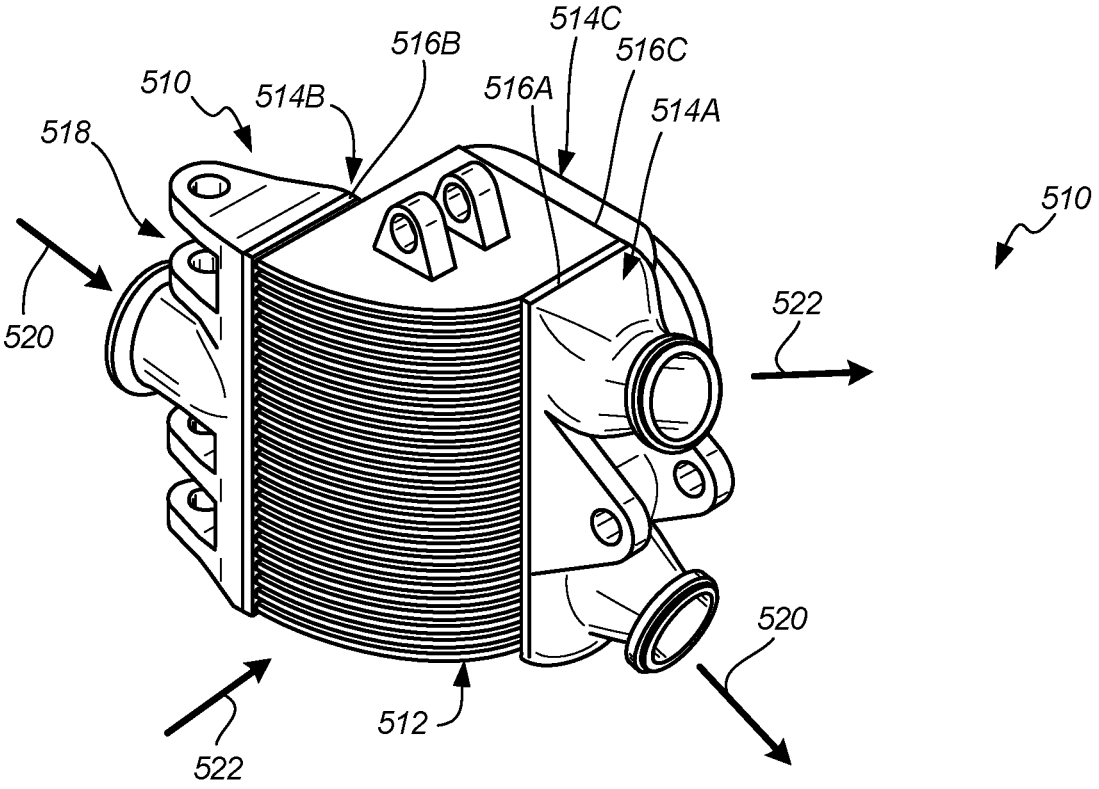

FIGS. 7A and 7B show two different perspective views of an alternate embodiment of heat exchanger assembly 510. Manifolds 514A, 514B, 514C meet core 512 at corresponding interfaces 516A, 516B, 516C. Assembly 510 has several mount locations 518 formed integrally with at least one manifold (here manifolds 514A, 514B). Like other embodiments, core 512 places first and second mediums 520, 522 in at least one heat exchange relationship.

With that, a method of making a heat exchanger includes forming a housing for a heat exchanger core and additively manufacturing the heat exchanger core. This can be done, for example, by forming a first load-bearing region in connection with the joint and/or mount, and forming a first non-load bearing region outward of the non-load bearing region. In certain embodiments, the core includes a different topology in the first load-bearing region than in the first non-load-bearing region. In certain of these embodiments, the core is formed such that the first load-bearing region is aligned with the at least one integrally formed joint such that a load path includes both the first load-bearing region and the at least one integrally formed joint.

In certain embodiments, the mount is formed with at least one core wall (e.g. one or more tube walls of a shell-and-tube heat exchanger assembly) via one or more of a casting process or an additive manufacturing process. In certain of these embodiments, the mount is integrally formed with at least one of a mount pad and an end plate of the heat exchanger core.

In each example, the important manufacturing aspect includes integrally forming parts to have the desired local impact. For example, one can integrally form the mount with at least one core wall of the heat exchanger assembly via one or more of a casting process or an additive manufacturing process. The mount includes at least one clevis integrally supporting at least one tube of the shell-and-tube heat exchanger. The mount can be integrally formed with at least one of a mount pad and an end plate of the heat exchanger core. The core can be formed with a first load-bearing region in connection with the joint/mount and a first non-load bearing region outward of the non-load bearing region. The core includes a different topology in the first load-bearing region than in the first non-load-bearing region. The first load-bearing region is aligned with the at least one integrally formed joint such that a load path includes both the first load-bearing region and the at least one integrally formed joint.

Discussion of Possible Embodiments

The following are non-exclusive descriptions of possible embodiments of the present invention.

An embodiment of a heat exchanger assembly includes a first manifold adapted for receiving a first medium, a core adapted for receiving and placing a plurality of mediums, including the first medium, in at least one heat exchange relationship, and a core meeting the first manifold at a first core/manifold interface; The mounting structure supports a heat exchanger, and is metallurgically joined to at least one heat exchanger assembly component at a first joint integrally formed with the mounting structure.

The heat exchanger assembly of the preceding paragraph can optionally include, additionally and/or alternatively, any one or more of the following features, configurations and/or additional components:

A heat exchanger assembly according to an exemplary embodiment of this disclosure, among other possible things includes a first manifold adapted for receiving a first medium; a core adapted for receiving and placing a plurality of mediums, including the first medium, in at least one heat exchange relationship, the core meeting the first manifold at a first core/manifold interface; and a mounting structure for supporting the heat exchanger, the mounting structure metallurgically joined to at least one heat exchanger assembly component at a first joint integrally formed with the mounting structure.

A further embodiment of the foregoing heat exchanger assembly, wherein the heat exchanger comprises a shell-and-tube heat exchanger or a micro-channel heat exchanger.

A further embodiment of any of the foregoing heat exchanger assemblies, wherein the mounting structure includes at least one clevis leg or bar integrally supported by at least one tube of the shell-and-tube heat exchanger.

A further embodiment of any of the foregoing heat exchanger assemblies, wherein the mounting structure is integrally formed with the heat exchanger core.

A further embodiment of any of the foregoing heat exchanger assemblies, wherein the core receives the first medium of the plurality of mediums flowing in a first direction and a second medium of the plurality of mediums flowing in a second direction at any angle relative to the first direction.

A further embodiment of any of the foregoing heat exchanger assemblies, wherein the core comprises a first load-bearing region in connection with the joint, a first non-load bearing region outward of the non-load bearing region, and a transition region therebetween.

A further embodiment of any of the foregoing heat exchanger assemblies, wherein the core includes a different topology in the first load-bearing region than in the first non-load-bearing region.

A further embodiment of any of the foregoing heat exchanger assemblies, wherein the first load-bearing region is aligned with the at least one integrally formed joint such that a load path includes both the first load-bearing region and the at least one integrally formed joint.

A further embodiment of any of the foregoing heat exchanger assemblies, wherein the heat exchanger is a plate-and-fin heat exchanger.

A further embodiment of any of the foregoing heat exchanger assemblies, wherein the mount is integrally formed with the first manifold.

An embodiment of a method of making a heat exchanger assembly includes forming a mounting structure for a heat exchanger assembly, and integrally forming the mounting structure with at least one component of the heat exchanger assembly via a first joint formed from one or more of a casting process or an additive manufacturing process.

The method of the preceding paragraph can optionally include, additionally and/or alternatively, any one or more of the following steps, features, configurations and/or additional components:

A method according to an exemplary embodiment of this disclosure, among other possible things includes forming a mounting structure for a heat exchanger assembly; and integrally forming the mounting structure with at least one component of the heat exchanger assembly via a first joint formed from one or more of a casting process and an additive manufacturing process.

A further embodiment of the foregoing method, wherein the heat exchanger comprises a shell-and-tube heat exchanger or a micro-channel heat exchanger.

A further embodiment of any of the foregoing methods, wherein the mounting structure includes at least one clevis integrally supported by at least one tube of the heat exchanger.

A further embodiment of any of the foregoing methods, wherein the mounting structure is integrally formed with a heat exchanger core.

A further embodiment of any of the foregoing methods, wherein the core receives a first medium flowing in a first direction and a second medium flowing in a second direction at any angle relative to the first direction.

A further embodiment of any of the foregoing methods, wherein the core comprises a first load-bearing region in connection with the joint, a first non-load bearing region outward of the non-load bearing region and a transition region therebetween.

A further embodiment of any of the foregoing methods, wherein a first layer of the core includes a topology in the first load-bearing region different from a topology in the first non-load-bearing region of the first layer.

A further embodiment of any of the foregoing methods, wherein the first load-bearing region is aligned with the at least one integrally formed joint such that a load path includes both the first load-bearing region and the at least one integrally formed joint.

A further embodiment of any of the foregoing methods, wherein the heat exchanger is a plate-and-fin heat exchanger.

A further embodiment of any of the foregoing methods, wherein the mount is integrally formed with a housing of a heat exchanger manifold.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger assembly comprising:

a first manifold adapted for receiving a first medium;

a core configured to receive and place a plurality of mediums, including the first medium, in at least one heat exchange relationship, the core meeting the first manifold at a first core/manifold interface, the core comprising:

a load-bearing portion adjacent a mount portion on a perimeter of the core, the load-bearing portion comprising a first plurality of adjacent corrugated fins having a first fin thickness; and a non-load-bearing portion adjacent the load-bearing portion and on a side opposite the mount portion, the non-load-bearing portion comprising a second plurality of adjacent corrugated fins with a second thickness less than the first thickness; and a transition region joining the first plurality of corrugated fins and the second plurality of corrugated fins;

wherein a topology of the load-bearing portion has a load bearing capacity greater than a load bearing capacity of the non-load-bearing portion;

a mount configured to support the core, wherein the mount is integrally formed with the core at a first joint integrally formed with the mount, wherein the core and the mount are built by additive manufacturing, such that the core and the mount are integrally formed together during an additive manufacturing process.

2. The heat exchanger assembly of claim 1, wherein the core receives the first medium of the plurality of mediums flowing in a first direction and a second medium of the plurality of mediums flowing in a second direction at any angle relative to the first direction.

3. The heat exchanger assembly of claim 1, wherein the first load-bearing region is aligned with the at least one integrally formed joint such that a load path includes both the first load-bearing region and the at least one integrally formed joint.

4. The heat exchanger assembly of claim 1, wherein the mount is integrally formed with the first manifold.

5. The heat exchanger core of claim 1, wherein a pitch of the plurality of corrugated fins in the load-bearing portion is less than a pitch of the plurality of corrugated fins in the non-load-bearing portion.

* * * * *